US010550445B2

(12) United States Patent
Saddik et al.

(10) Patent No.: US 10,550,445 B2
(45) Date of Patent: Feb. 4, 2020

(54) COATED IRON ORE PELLETS AND A PROCESS OF MAKING AND REDUCING THE SAME TO FORM REDUCED IRON PELLETS

(71) Applicant: SABIC GLOBAL TECHNOLOGIES B.V., Bergen op Zoom (NL)

(72) Inventors: Mohamed Bahgat Saddik, Jubail (SA); Sayed Niaz Ahsan, Jubail (SA); Shabbir Taherbhai Lakdawala, Jubail (SA); Hesham Ahmed Hanafy, Jubail (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 15/741,935

(22) PCT Filed: Jun. 20, 2016

(86) PCT No.: PCT/IB2016/053663
§ 371 (c)(1),
(2) Date: Jan. 4, 2018

(87) PCT Pub. No.: WO2017/006200
PCT Pub. Date: Jan. 12, 2017

(65) Prior Publication Data

US 2018/0195140 A1 Jul. 12, 2018

Related U.S. Application Data

(60) Provisional application No. 62/189,517, filed on Jul. 7, 2015.

(51) Int. Cl.

| | |
|---|---|
| ***B32B 5/16*** | (2006.01) |
| ***B05D 7/00*** | (2006.01) |
| ***C21B 13/00*** | (2006.01) |
| ***C22B 1/24*** | (2006.01) |
| ***C21B 11/10*** | (2006.01) |
| ***C22B 1/243*** | (2006.01) |

(52) U.S. Cl.
CPC ..... *C21B 13/0046* (2013.01); *C21B 11/10* (2013.01); *C22B 1/243* (2013.01); *C22B 1/2406* (2013.01)

(58) Field of Classification Search
CPC ..... C21B 11/10
USPC ..... 428/403
See application file for complete search history.

(56) References Cited

U.S. PATENT DOCUMENTS

| | | | | |
|---|---|---|---|---|
| 5,476,532 | A * | 12/1995 | Steeghs | C21B 13/00 75/300 |
| 7,226,495 | B1 | 6/2007 | Mourao et al. | 75/773 |
| 2013/0111809 | A1 | 5/2013 | Kamikawa | 44/603 |
| 2018/0320246 | A1* | 11/2018 | Al-Tassan | C22B 1/2406 |

FOREIGN PATENT DOCUMENTS

| | | |
|---|---|---|
| BR | 199501228 | 1/1996 |
| CA | 1044897 | 12/1978 |
| CN | 104099468 | 10/2014 |
| EP | 495455 | 4/1997 |
| GB | 1514777 | 6/1978 |
| JP | 2008214715 | 9/2008 |
| WO | WO 2017/006200 | 1/1917 |
| WO | WO 2015/016145 | 2/2015 |
| WO | WO 2015/068104 | 5/2015 |

OTHER PUBLICATIONS

Abzalov et al., "Technology for Applying the coatings on pellets for direct reduction processes" *Stal*, (2003), 9: 15-17.
Basdag et al., "Coating of iron oxide pellets for direct reduction" *Scandinavian Journal of Metallurgy*, (2002), 31: 229-233.
Castro et al., "Effect of Different Coatings on the Adherence of Direct Reduction Pellets" *Iron Making Conference Proceedings*, (2003), 4: 195-202.
International Search Report and Written Opinion issued in International Application No. PCT/IC2016/053663, dated Oct. 31, 2016.
Umadevi et al., "Influence of Coating Granulation Process on Iron Ore Sinter Quality and Productivity," *Steel Research Int.* (2010), 81(9): 716-723.
Yi et al., "Sticking of iron ore pellets in direct reduction with hydrogen and carbon monoxide: Behavior and Prevention," *J. Cent. South Univ.*, (2014), 21: 506-510.

* cited by examiner

*Primary Examiner* — Hoa (Holly) Le
(74) *Attorney, Agent, or Firm* — Norton Rose Fulbright US LLP

(57) ABSTRACT

Iron ore pellets including a core comprising iron ore, a first coating comprising lime, and a second coating comprising cement, wherein the first coating is disposed between a surface of the core and the second coating. A process for manufacturing the iron ore pellets whereby the first coating is applied to the core to form a coated core, the surface area coverage of the first coating is measured, the second coating is applied to the coated core, and the surface area coverage of the second coating is measure. A process for manufacturing reduced iron pellets is also provided whereby the iron ore pellets are reduced with a reducing gas at temperatures up to 1100° C.

18 Claims, No Drawings

COATED IRON ORE PELLETS AND A PROCESS OF MAKING AND REDUCING THE SAME TO FORM REDUCED IRON PELLETS

CROSS-REFERENCE TO RELATED APPLICATIONS

This application is a national phase under 35 U.S.C. § 371 of International Application No. PCT/IB2016/053663, filed Jun. 20, 2016, which claims the benefit of U.S. Provisional Patent Application No. 62/189,517, filed Jul. 7, 2015. The entire contents of each of the above-referenced applications are incorporated into the present application by reference.

BACKGROUND OF THE DISCLOSURE

Technical Field

The present disclosure relates to iron ore pellets that contain a first and a second coating, a process for manufacturing the iron ore pellets, and a process of reducing the iron ore pellets to form reduced iron pellets.

Description of the Related Art

Direct reduction (DR) of iron ores is a fundamental step in commercial iron making. Several direct reduction process, including those using fine ore, lump ores and pellets, have been developed. Some processes use natural gas as fuel reductant, whereas others are based on coal. Approximately 90% of directly reduced iron (DRI) in the world is produced by gas-based vertical shaft furnace processes owing to their advantages of low energy consumption and high productivity. Two of the most common vertical shaft furnace processes are those developed by Midrex (USA) and Tenova HYL (Mexico), both use pellets and/or lumps of iron ores as feed stock.

One of the most serious drawbacks encountered with gaseous shaft furnaces is the sticking or agglomerating among individual iron ore pellets. This unintended agglomeration of pellets can make continuous operation difficult. The sticking tendency imposes an upper limit on the reduction temperature and, hence, on the productivity of the reduction process. In direct reduction processes the product is freshly reduced iron in a solid state. Therefore, it is crucial for the material flow in the reducing module that the solid product does not agglomerate or form aggregates that block the material flow within and out of the reactor. If the pellets have little or no tendency to stick then the reduction temperature, and therefore the material throughput, can be increased. An increase of 100° C. in the reduction temperature can significantly increase throughput by increasing the rate of reduction. High reduction temperature also minimizes degradation and re-oxidation of the reduced product.

Decreasing the reducing temperature to avoid the problem of agglomeration can cause a significant drop in throughput. As an example, a decrease from 850 to 750° C. can result in a decrease of 30-40% in throughput. The problem of agglomeration has been studied by many researchers. Results from these investigations indicate that the sticking behavior of pellets is a result of the growth of fibrous iron precipitates (iron whiskers) that become hooked to each other and finally become crystallized during the initial stages of metallization. One way to prevent pellet agglomeration is to coat the iron surfaces with a coating material that is inactive under the reducing conditions in the shaft furnace

[Berrun-Castanon, J. et al. U.S. Pat. No. 5,181,954; Goetzman, H. U.S. Pat. No. 3,975,182; Sandoval, J. GB1514777—each incorporated herein by reference in its entirety]. However, a single coating has drawbacks that include ineffective agglomerate prevention during reduction and the loss of the coating prematurely during shipment or movement prior to the reduction.

In view of the forgoing, one aspect of the present disclosure is to provide iron ore pellets comprising a core comprising iron ore that is coated with a first coating and a second coating, and a process for manufacturing the iron ore pellets and reducing the iron ore pellets to form reduced iron pellets.

BRIEF SUMMARY OF THE DISCLOSURE

According to a first aspect, the present disclosure relates to iron ore pellets including i) a core comprising iron ore ii) a first coating comprising lime and iii) a second coating comprising cement, wherein the first coating is disposed between a surface of the core and the second coating. Optionally, the first and/or the second coating can also include bauxite, bentonite, or dolomite, or combinations thereof. In yet another embodiment, the lime in the first coating or the cement in the second coating can be replaced with bauxite, bentonite, or dolomite, or combinations thereof.

In one embodiment, the first coating covers greater than 75% of the surface of the core.

In one embodiment, the first coating covers greater than 85% of the surface of the core.

In one embodiment, the iron ore pellets have a wt. % of the first coating ranging from 0.05-1% relative to the total weight of the iron ore pellets.

In one embodiment, an average thickness of the first coating is 50-100 μm.

In one embodiment, the second coating covers greater than 75% of the surface of the first coating.

In one embodiment, the iron ore pellets have a wt. % of the second coating ranging from 0.05-2% relative to the total weight of the iron ore pellets.

In one embodiment, an average thickness of the second coating is 50-100 μm.

In one embodiment, the second coating comprises grains with an average particle size of 1-20 μm.

In one embodiment, the iron ore pellets have an average pellet diameter of 8-20 mm.

In one embodiment, the first and second coating reduce the formation of agglomerated iron ore pellets compared to a core without the first coating, the second coating, or both.

In one embodiment, the iron ore pellets have a % agglomeration of less than 5% in terms of the wt. % of agglomerated iron ore pellets with a longest length of at least 25 mm relative to the total weight of the iron ore pellets.

In one embodiment, the thickness of the first and second coating decreases by no more than 60% after rotating the iron ore pellets at 10-30 rpm, in terms of the average coating thickness of the sum of the first and second coating.

According to a second aspect, the present disclosure relates to a process for manufacturing the iron ore pellets of the present disclosure, in one or more of their embodiments, including i) applying at least one selected from the group consisting of bauxite, bentonite, and dolomite to a core comprising iron ore to form a coated core coated with a first coating ii) measuring a surface area coverage of the first coating on the core iii) applying lime, cement, or both to the coated core to form the iron ore pellets coated with the first coating and a second coating and iv) measuring a surface area coverage of the second coating on the first coating.

In one embodiment, the first coating is applied to the core as a slurry comprising 10-30 wt. %, preferably 15-25 wt. %, or more preferably 18-22 wt. % or about 20 wt. % of lime relative to the total weight of the slurry, and the second coating is applied to the core coated with a first coating as a slurry comprising 10-30 wt. %, preferably 15-25 wt. %, or more preferably 18-22 wt. % or about 20 wt. % of cement relative to the total weight of the slurry. Optionally, the first and/or the second coating can also include bauxite, bentonite, or dolomite, or combinations thereof. In yet another embodiment, the lime in the first coating or the cement in the second coating can be replaced with bauxite, bentonite, or dolomite, or combinations thereof. In a preferred embodiment, the lime coating is applied in an amount of 0.5-1.5 kg, preferably 0.7-1.3 kg, or more preferably about 1 kg lime/ton of iron ore, and the cement coating is applied in an amount of 0.3-0.7 kg, preferably 0.4-0.6 kg, or more preferably about 0.5 kg cement/ton of iron ore.

In one embodiment, the process further involves tumbling the iron ore pellets and weighing agglomerated iron ore pellets with a longest length of at least 25 mm relative to the total weight of the iron ore pellets to determine a % agglomeration.

In one embodiment, the process further comprises rotating the iron ore pellets at 10-30 rpm and determining the % reduction of a thickness of the first and second coating after the rotating, in terms of the average coating thickness of the sum of the first and second coating.

According to a third aspect, the present disclosure relates to a process for manufacturing reduced iron pellets involving i) applying lime to a core comprising iron ore to form a coated core coated with a first coating ii) applying cement to the coated core to form iron ore pellets coated with the first coating and a second coating and iii) reducing the iron ore pellets with a reducing gas at temperatures up to 1100° C. to form reduced iron pellets. Optionally, the first and/or the second coating can also include bauxite, bentonite, or dolomite, or combinations thereof. In yet another embodiment, the lime in the first coating or the cement in the second coating can be replaced with bauxite, bentonite, or dolomite, or combinations thereof.

In one embodiment, the process further comprises tumbling the reduced iron pellets and weighing agglomerated reduced iron pellets with a longest length of at least 25 mm relative to the total weight of the reduced iron pellets to determine a % agglomeration.

In one embodiment, the process further includes rotating the reduced iron pellets at 10-30 rpm and determining the % reduction of a thickness of the first and second coating after the rotating, in terms of the average coating thickness of the sum of the first and second coating.

Also disclosed in the context of the present invention are embodiments 1-19. Embodiment 1 is iron ore pellets, comprising: a core comprising iron ore; a first coating comprising at least one selected from the group consisting of bauxite, bentonite, and dolomite; and a second coating comprising lime, cement or both, wherein the first coating is disposed between a surface of the core and the second coating. Embodiment 2 is the iron ore pellets of embodiment 1, wherein the first coating covers greater than 75% of the surface of the core. Embodiment 3 is the iron ore pellets of embodiment 1, wherein the first coating covers greater than 85% of the surface of the core. Embodiment 4 is the iron ore pellets of embodiment 1, which have a wt. % of the first coating ranging from 0.05-1% relative to the total weight of the iron ore pellets. Embodiment 5 is the iron ore pellets of embodiment 1, wherein an average thickness of the first coating is 50-100 μm. Embodiment 6 is the iron ore pellets of embodiment 1, wherein the second coating covers greater than 75% of the surface of the first coating. Embodiment 7 is the iron ore pellets of embodiment 1, which have a wt. % of the second coating ranging from 0.05-2% relative to the total weight of the iron ore pellets. Embodiment 8 is the iron ore pellets of embodiment 1, wherein an average thickness of the second coating is 50-100 μm. Embodiment 9 is the iron ore pellets of embodiment 1, wherein the second coating comprises grains with an average particle size of 1-20 μm. Embodiment 10 is the iron ore pellets of embodiment 1, which have an average pellet diameter of 8-20 mm. Embodiment 11 is the iron ore pellets of embodiment 1, wherein the first and second coating reduce the formation of agglomerated iron ore pellets compared to a core without the first coating, the second coating, or both. Embodiment 12 is the iron ore pellets of embodiment 11, which have a % agglomeration of less than 5% in terms of the wt. % of agglomerated iron ore pellets with a longest length of at least 25 mm relative to the total weight of the iron ore pellets. Embodiment 13 is the iron ore pellets of embodiment 1, wherein the thickness of the first and second coating decreases by no more than 60% after rotating the iron ore pellets at 10-30 rpm, in terms of the average coating thickness of the sum of the first and second coating. Embodiment 14 is a process for manufacturing the iron ore pellets of embodiment 1, comprising: applying at least one selected from the group consisting of bauxite, bentonite, and dolomite to a core comprising iron ore to form a coated core coated with a first coating; measuring a surface area coverage of the first coating on the core; applying lime, cement, or both to the coated core to form the iron ore pellets coated with the first coating and the second coating; and measuring a surface area coverage of the second coating on the first coating. Embodiment 15 is the process of embodiment 14, wherein the first coating is applied to the core as a slurry comprising 10-30 wt. % of bauxite, bentonite or dolomite relative to the total weight of the slurry, and the second coating is applied to the core coated with a first coating as a slurry comprising 10-30 wt. % of lime, cement, or both relative to the total weight of the slurry. Embodiment 16 is the process of embodiment 14, further comprising rotating the iron ore pellets at 10-30 rpm and determining the % reduction of a thickness of the first and second coating after the rotating, in terms of the average coating thickness of the sum of the first and second coating. Embodiment 17 is a process for manufacturing reduced iron pellets, comprising: applying at least one selected from the group consisting of bauxite, bentonite, and dolomite to a core comprising iron ore to form a coated core coated with a first coating; applying lime, cement, or both to the coated core to form the iron ore pellets of embodiment 1 coated with the first coating and the second coating; and reducing the iron ore pellets with a reducing gas at temperatures up to 1100° C. to form reduced iron pellets. Embodiment 18 is the process of embodiment 17, further comprising tumbling the reduced iron pellets and weighing agglomerated reduced iron pellets with a longest length of at least 25 mm relative to the total weight of the reduced iron pellets to determine a % agglomeration. Embodiment 19 is the process of embodiment 17, further comprising rotating the reduced iron pellets at 10-30 rpm and determining the % reduction of a thickness of the first and second coating after the rotating, in terms of the average coating thickness of the sum of the first and second coating.

DETAILED DESCRIPTION OF THE EMBODIMENTS

According to a first aspect, the present disclosure relates to iron ore pellets including a core comprising iron ore. Iron ores are rocks and minerals from which metallic iron can be extracted. The ores are typically rich in iron oxides and vary in color from dark grey, bright yellow, deep purple to rusty red. The iron itself is found in the form of magnetite ($Fe_3O_4$, 72.4% Fe), hematite ($Fe_2O_3$, 69.9% Fe), goethite (FeO(OH), 62.9% Fe), limonite (FeO(OH).n($H_2O$)) or siderite ($FeCO_3$, 48.2% Fe), and mixtures thereof. Ores containing relatively high quantities of hematite or magnetite (greater than ~60% iron) are known as natural ore or direct shipping ore. These ores can be fed directly into iron-making blast furnaces. Iron ore is the raw material used to make pig iron, which is one of the main raw materials used to make steel.

Iron (III) oxide or ferric oxide is an inorganic compound with formula $Fe_2O_3$. It is one of the three main oxides of iron, the other two being iron (II) oxide (FeO) which is rare, and iron (II, III) oxide ($Fe_3O_4$) which also occurs naturally as the mineral magnetite. As the mineral known as hematite, $Fe_2O_3$ is the main source of iron for the steel industry. $Fe_2O_3$ is ferromagnetic, dark red and readily attacked by acids. $Fe_2O_3$ can be obtained in various polymorphs. In the major polymorphs, α and γ, iron adopts an octahedral coordination geometry, where each Fe center is bound to six oxygen ligands. α-$Fe_2O_3$ has a rhombohedral corundum (α-$Al_2O_3$) structure and is the most common form of hematite. It occurs naturally and is mined as the main ore of iron. γ-$Fe_2O_3$ has a cubic structure, is metastable and converts to the alpha phase at high temperatures. It is also ferromagnetic.

Several other phases of iron oxide have been identified, including the β-phase, which is cubic body centered, metastable, and at temperatures above 500° C. converts to the alpha phase, and the epsilon phase, which is rhombic and shows properties intermediate between alpha and gamma phase. This phase is also metastable, transforming to the alpha phase between 500 and 750° C. Additionally, at high pressure an iron oxide can exist in an amorphous form.

The iron ore in the core of the present disclosure may have an a polymorph, a β polymorph, a γ polymorph, an c polymorph, or mixtures thereof. The iron (III) oxide in the core may also be in the form of an iron hydrate. When alkali is added to solutions of soluble Fe(III) salts a red-brown gelatinous precipitate forms, which is $Fe_2O_3.H_2O$ (also written as Fe(O)OH). Several forms of the hydrate oxide of Fe(III) exist as well.

The term "core" as used herein refers to an iron rich material (i.e. greater than 40%, preferably greater than 50%, more preferably greater than 60% elemental iron by weight based on the total weight of the core), onto which a single or a plurality of coatings are added to form a surface coated core.

The core may be a porous starting material that becomes coated, and the interface between the core and the coating material may also form pores. In this disclosure, "porosity" is an index showing a ratio of void volume with respect to an entire volume of a structure (e.g. the core, the first coating, the second coating). The porosity can be calculated, for example, by taking a photograph of the cross sectional structure, measuring a total void area using the photograph, and calculating the porosity as a ratio of void area with respect to an entire cross sectional area of the structure. In one embodiment, the core has a porosity of 1-40%, preferably 5-35%, more preferably 10-30%.

In the present disclosure, the core may be coated with a thin coating. Therefore, the general shape and size of the core may dictate the shape and size of the iron ore pellets described herein. In a preferred embodiment, the cores of the present disclosure are in the form of a pellet, which is a spherical or substantially spherical (e.g. oval, oblong, etc.) shape. However, the cores disclosed herein may have various shapes other than spheres. For instance, it is envisaged that cores may be in the shape of a "lump" or a "briquette". Lumps or briquettes tend to have a more cubical or rectangular shape when compared to pellet forms. Therefore, the cores of the present disclosure may also be generally cubic or rectangular. The size of the core may also dictate the size of the iron ore pellets herein. In one embodiment, the core has an average diameter of 8-20 mm, preferably 9-18 mm, more preferably 10-16 mm, although the size may be vary from these ranges and still provide acceptable iron ore pellets.

In addition to iron and/or iron oxide, various non-ferrous materials (i.e. metals and non-metals) may be present in the core including aluminum, copper, lead, nickel, tin, titanium, zinc, bronze, metal oxides thereof, metal sulfides thereof, calcium oxide, magnesium oxide, magnesite, dolomite, aluminum oxide, manganese oxide, silica, sulfur, phosphorous, and combinations thereof. The total weight % of these non-ferrous materials relative to the total wt. of the core is typically no more 40%, preferably no more than 30%, preferably no more 20%, preferably no more than 15%, preferably no more than 10%, preferably no more 5%, preferably no more than 4%, preferably no more than 3%, preferably no more 2%, more preferably no more than 1%.

The conventional route for making steel includes use of a facility that includes sintering or pelletization plants, coke ovens, blast furnaces, and basic oxygen furnaces. Such plants require high capital expenses and raw materials of stringent specifications. Direct reduction, an alternative route of iron making, has been developed to overcome some of these difficulties of conventional blast furnaces. Iron ore is reduced in solid state to form direct-reduced iron (DRI). The most important reaction of iron (III) oxide is its carbothermal reduction, which gives iron used in steel-making (formula I):

$$Fe_2O_3+3CO \rightarrow 2Fe+3CO_2 \quad (I)$$

The specific investment and operating costs of direct reduction plants are low compared to integrated steel plants. As used herein, direct-reduced iron (DRI), also known as sponge iron, is produced from the direct reduction of iron ore in the form of lumps, pellets or fines by a reducing gas produced from natural gas or coal. The reducing gas is a mixture, the majority of which is hydrogen ($H_2$) and carbon monoxide (CO) which act as reducing agents. Direct reduced iron has about the same iron content as pig iron, typically 90-94%.

The direct reduction of iron ore pellets at high temperature (e.g. greater than 400° C.) may lead to the formation of agglomerates. As used herein, the term "agglomerates" or "agglomerated" refers to two or more iron ore pellets, either coated (i.e. a first coating, a second coating, or both) or non-coated (i.e. the core itself), which are attached to one another thereby forming a pellet cluster that has a longest length of at least 25 mm in any measurable direction. For spherical or substantially spherical pellet agglomerates, longest length refers to the longest linear diameter of the pellet agglomerate. For non-spherical pellet agglomerates, such as pellet agglomerates that form a cubic shape, the longest length may refer to any of the length, width, or height of the agglomerate. The iron ore pellets may be attached to each other in any reasonable manner, including attached through surface coating interactions (e.g. glued, tacked, cemented, pasted, etc.), attached by highly connected or integral interactions (e.g. melted together, fused, sintered, amalgamated, etc.), or entrapped within a cluster (e.g. sandwiched between a plurality of attached pellets). The iron ore pellets may also be attached as a result of interlocking fibrous iron precipitates (iron whiskers). For instance, growth of iron whiskers may lead to pellets that are hooked or entangled to each other through the fibrous iron whiskers. Therefore, one object of the present disclosure is to provide a coating for iron ore that prevents the formation of agglomerates before, during, and/or after direct reduction processes.

The iron ore pellets of the present disclosure also include a first coating comprising lime. The core coated with a first coating is referred to herein as a "coated core". Optionally, the first coating can also include bauxite, bentonite, or dolomite, or combinations thereof. In yet another embodiment, the lime in the first coating can be replaced with bauxite, bentonite, or dolomite, or combinations thereof.

Lime is a calcium-containing inorganic material in which carbonates, oxides and hydroxides predominate. Lime may refer to quicklime or burnt lime, which is calcium oxide that has been derived from calcining limestone. Lime may also refer to hydrated lime or slaked lime, which is calcium hydroxide which has been derived from the hydration of quicklime. Therefore, "lime" as used herein, may refer to calcium carbonate, calcium oxide, or calcium hydroxide containing materials, and mixtures thereof. In one embodiment, the second coating comprises lime and the lime second coating comprises greater than 70%, preferably greater than 80%, preferably greater than 85%, preferably greater than 90%, preferably greater than 95% calcium-containing materials (e.g. CaO, $CaCO_3$, $Ca(OH)_2$, etc.). Other inorganic compounds may be present in the lime second coating, such as MnO, $SiO_2$, MgO, $Fe_2O_3$, etc., with these compounds generally being present in less than 10% relative to the total weight % of the lime, if at all.

Bauxite is an aluminum ore and the predominant source of aluminum throughout the world. It consists mostly of the minerals gibbsite $Al(OH)_3$, boehmite $\gamma$-AlO(OH) and diaspore $\alpha$-AlO(OH), mixed with the two iron oxides goethite FeO(OH) and hematite ($Fe_2O_3$), the clay mineral kaolinite $Al_2Si_2O_5(OH)_4$ and small amounts of anatase $TiO_2$. Lateritic bauxites (silicate bauxites) are distinguished from karst bauxite ores (carbonate bauxites). In one embodiment, the first coating comprises bauxite and the bauxite first coating comprises 40-60% $Al_2O_3$, 10-30% $Fe_2O_3$, 0.1-10% $SiO_2$, and 1-3% $TiO_2$. Other inorganic compounds may be present in the bauxite first coating, such as $P_2O_5$, MnO, MgO, CaO, etc., with these compounds generally being present in less than 5% relative to the total weight % of the bauxite, if at all.

Bentonite is an absorbent aluminum phyllosilicate, impure clay consisting primarily of montmorillonite. Montmorillonite generally comprises sodium, calcium, aluminum, magnesium, and silicon, and oxides and hydrates thereof. Other compounds may also be present in the bentonite of the present disclosure, including, but not limited to, potassium-containing compounds, and iron-containing compounds. There are different types of bentonite, named for the respective dominant element, such as potassium (K), sodium (Na), calcium (Ca) and aluminum (Al). Therefore, in terms of the present disclosure "bentonite" may refer to potassium bentonite, sodium bentonite, calcium bentonite, aluminum bentonite, and mixtures thereof, depending on the relative amounts of potassium, sodium, calcium, and aluminum in the bentonite first coating.

Dolomite is an anhydrous carbonate mineral composed of calcium magnesium carbonate, e.g. $CaMg(CO_3)_2$. Dolomite can also describe the sedimentary carbonate rock composed primarily of the mineral dolomite, known as dolostone or dolomitic limestone. The mineral dolomite crystallizes in the trigonal-rhombohedral system and forms white, tan gray or pink crystals. Dolomite is a double carbonate, having an alternating structural arrangement of calcium and magnesium ions. In one embodiment, the first coating comprises dolomite and the dolomite first coating comprises 15-25% Ca, 10-20% Mg, 10-20% C, and 40-60% O, with the calcium and magnesium being present primarily as oxides or hydroxides. Other inorganic compounds may be present in the dolomite first coating, such as $Al_2O_3$, MnO, $Fe_2O_3$, etc., with these compounds generally being present in less than 5% relative to the total weight % of the dolomite, if at all.

It is envisaged that other types of sedimentary rock sources may be used in lieu of lime, bauxite, bentonite, or dolomite as material in the first coating, including, but not limited to, limestone, calcite, vaterite, aragonite, magnesite, taconite, gypsum, quartz, marble, hematite, limonite, magnetite, andesite, garnet, basalt, dacite, nesosilicates or orthosilicates, sorosilicates, cyclosilicates, inosilicates, phyllosilicates, tectosilicates, and the like.

"Coating", "coat", or "coated" as used herein, refers to a covering that is applied to a surface of the core or a coated core. The coating may "substantially cover" the surface, whereby the % surface area coverage of the surface being coated is at least 75%, at least 80%, at least 85%, at least 90%, at least 95%, at least 96%, at least 97%, at least 98%, at least 99%. In some cases, the coating may "incompletely cover", or only cover portions of the surface being coated, whereby the % surface area coverage of the surface being coated is less than 75%, less than 65%, less than 60%, less than 55%, less than 50%, less than 45%, less than 40%, less than 35%, less than 30%, less than 25%, less than 20%, less than 15%, less than 10%. The "coating" or "coat" may refer to one material (i.e. lime, cement, dolomite, bauxite, bentonite, etc.) that covers a surface being coated, or alternatively, the coating may refer to a plurality of materials (i.e. mixtures) that cover a surface being coated. The plurality of materials may be applied to a surface as a mixture or sequential applications of the individual materials. With sequential applications of individual materials, it may be possible to form distinct layers. These distinct layers may have a defined interface. The coating thickness of the present disclosure may be varied depending on the coating materials and the process for applying the coating. The term "coating" may also refer to a single application of a material, or a plurality of applications of the same material.

In one embodiment, the first coating substantially covers the core, where the first coating covers greater than 75%, preferably greater than 85, preferably greater than 90%, preferably greater than 95% of the surface of the core. Alternatively, the first coating may be applied to only a portion of the surface of the core (i.e. incompletely cover), and the applied coating may still prevent agglomeration.

In one embodiment, the iron ore pellets have a wt. % of the first coating ranging from 0.05-1%, preferably 0.1-0.8%, more preferably 0.2-0.6% relative to the total weight of the iron ore pellets.

In one embodiment, an average thickness of the first coating is 50-100 μm, preferably 60-90 μm, more preferably 70-80 μm. In one embodiment, the first coating is uniform.

Alternatively, the first coating may be non-uniform. The term "uniform" refers to an average coating thickness that differs by no more than 50%, by no more than 25%, by no more than 10%, by no more than 5%, by no more than 4%, by no more than 3%, by no more than 2%, by no more than 1%, at any given location on the surface of the coated material. The term "non-uniform" refers to an average coating thickness that differs by more than 5% at any given location on the surface of the coated material.

The iron ore pellets further include a second coating comprising cement, wherein the first coating is disposed between a surface of the core and the second coating. Optionally, the second coating can also include bauxite, bentonite, or dolomite, or combinations thereof. In yet another embodiment, the cement in the second coating can be replaced with bauxite, bentonite, or dolomite, or combinations thereof.

A cement is a binder that comprises at least one selected from the group consisting of $SiO_2$, $Al_2O_3$, $Fe_2O_3$, MgO, and CaO, depending on the type of cement. There are many types of cements, including, Portland cement, silicaceous fly ash, calcareous fly ash, volcanic ash, slag cement, silica fume, pozzolan, and the like. In one embodiment, the cement of the present disclosure is a Portland cement. Portland cement is made primarily of calcium oxide, as well as a mixture of silicates and oxide. The four main components of Portland cement are belite ($2CaO.SiO_2$), alite ($3CaO.SiO_2$), celite ($3CaO.Al_2O_3$), and brownmillerite ($4CaO.Al_2O_3.Fe_2O_3$). In one embodiment, the cement is a slag cement. Slag cement is a type of cement produced by quenching molten iron slag (which is a byproduct of iron and steelmaking) from a blast furnace in water or steam to produce a granular cement product. The four main components of slag cement are CaO (30-50%), $SiO_2$ (28-38%), $Al_2O_3$ (8-24%), and MgO (1-18%). However, the chemical composition of slag cement varies considerably depending on the composition of the raw materials in the iron production process and therefore these percentages are given as just one example, and other % compositions may be used as the second coating in the present disclosure. As slag cement is a byproduct of iron making processes, the slag cement of the present disclosure may also contain iron or iron oxide materials.

In one embodiment, the second coating substantially covers the first coating. In this scenario, the second coating covers at least 75%, at least 80%, at least 85%, at least 90%, at least 95%, at least 96%, at least 97%, at least 98%, at least 99% of the surface of the first coating. Alternatively, the second coating may be applied to only a portion of the surface of the first coating (i.e. incompletely cover the first coating). In the scenario where the first coating incompletely covers the core, the second coating may cover the core rather than, or in addition to covering the first coating. In one embodiment, the iron ore pellets have a wt. % of the second coating ranging from 0.05-2%, preferably 0.1-1.5%, more preferably 0.2-1.0% relative to the total weight of the iron ore pellets.

In one embodiment, the second coating comprises grains with an average particle size of 1-20 μm, preferably 1-15 μm, more preferably 2-10 μm. In one embodiment, an average thickness of the second coating is 50-100 μm, preferably 60-90 μm, more preferably 70-80 μm. Similar to the coverage of the first coating, the second coating may cover the first coating and/or the core in a uniform fashion, or alternatively in a non-uniform fashion.

In a preferred embodiment, the first and second coatings form distinct layers with distinct and identifiable interfaces between the two layers. In one embodiment, the first and second coatings form distinct layers, although the interface between the two layers is a mixture of both the first and second layer. For example, in one embodiment the first layer consists of lime or a lime slurry comprising 10-30 wt. %, preferably 15-25 wt. %, or more preferably 18-22 wt. % or about 20 wt. % of lime, and the second layer consists of cement or a cement slurry comprising 10-30 wt. %, preferably 15-25 wt. %, or more preferably 18-22 or about 20 wt. % of cement. Preferably the major component of the first layer is not present in the second layer and the major component of the second layer is not present in the first layer.

In one embodiment, the iron ore pellets of the present disclosure have a porosity of 1-35%, preferably 5-30%, more preferably 10-25%.

The average thickness of both coatings (the first coating and the second coating) on the core is about 100-200 μm, preferably 120-180 μm, more preferably 140-160 μm. Further, the total weight percent of the sum of the first coating and second coating is 0.1-3%, preferably 0.2-2.5%, preferably 0.3-2%, more preferably 0.4-1.5% relative to the total weight of the iron ore pellets. The iron ore pellets may have an average pellet diameter of 8-20 mm, preferably 9-18 mm, more preferably 10-16 mm. In one embodiment, the iron ore pellet has a largest dimension of less than 50 mm. In one embodiment, a bulk sample of iron ore pellets has at least 90% by weight of the pellets with a largest dimension of less than 50 mm.

In one embodiment, the first and second coating reduce the formation of agglomerated iron ore pellets compared to a core without the first coating, the second coating, or both.

In one embodiment, the iron ore pellets have a % agglomeration of less than 5%, preferably less than 4%, preferably less than 3%, preferably less than 2%, preferably less than 1%, in terms of the wt. % of agglomerated iron ore pellets with a longest length of at least 25 mm relative to the total weight of the iron ore pellets.

In one embodiment, the thickness of the first and second coating decreases by no more than 60%, by no more than 50%, by no more than 40%, by no more than 30%, by no more than 20%, by no more than 10% after rotating the iron ore pellets at 10-30 rpm, in terms of the average coating thickness of the sum of the first and second coating [ASTM Volume 06.01 Paint Tests for Chemical, Physical, and Optical Properties; Appearance—incorporated herein by reference in its entirety].

According to a second aspect, the present disclosure relates to a process for manufacturing the iron ore pellets of the present disclosure, in one or more of their embodiments, including applying lime to a core comprising iron ore to form a coated core coated with a first coating. In one embodiment, the applying involves coating the core with a first coating, where the first coating covers greater than 75%, preferably greater than 85%, preferably greater than 90%, preferably greater than 95% of the surface of the core. Optionally, bauxite, bentonite, or dolomite, or combinations thereof can be included with the lime to form the first coating. In yet another embodiment, the lime in the first coating can be replaced with bauxite, bentonite, or dolomite, or combinations thereof.

In one embodiment, the first coating is applied to the core as a slurry comprising 10-30 wt. %, preferably 15-25 wt. %, more preferably 18-22 wt. % or about 20 wt. % of lime relative to the total weight of the slurry. "Slurry" as used herein refers to a semiliquid mixture typically of particles or particulate of the coating material suspended in liquid. The liquid used in the slurry is not envisioned as particularly limiting and is preferably water. In one embodiment, the slurry has a pH of 4-8, although the pH of the slurry may be more acidic or more basic depending on the application. The slurry may also refer to a suspension, a dispersion, an emulsion, etc. Optionally, bauxite, bentonite, or dolomite, or combinations thereof can be included with the lime slurry to form the first coating. In yet another embodiment, the lime slurry can be replaced with a slurry of bauxite, bentonite, or dolomite, or combinations thereof, in the same amounts as those stated directly above with respect to the lime slurry.

The slurry preferably comprises a solids concentration of no more than 15 kg of coating material per ton of iron ore pellets to be coated, preferably no more than 10 kg/ton, preferably no more than 5 kg/ton, preferably no more than 4 kg/ton, preferably no more than 3 kg/ton, preferably no more than 2 kg/ton, preferably no more than 1 kg/ton, preferably no more than 0.5 kg/ton, preferably no more than 0.25 kg/ton.

Several methods may be used to coat the core, including spray coating, dip coating, and spin coating. Spray coating is a process whereby the slurry is applied through the air to a surface as atomized particles using a spray coating device. A spray coating device may employ compressed gas, such as air, to atomize and direct the slurry.

Dip coating is a process whereby the pellet is inserted and removed from a bath of the slurry. The pellet is immersed in the slurry and the coating deposits itself on the pellet while being removed from the bath. The excess liquid can be drained from the pellet during this process and the liquid of the slurry can then be evaporated.

Spin coating is a process whereby a slurry is applied to the center of the pellet and the pellet is then rotated at high speed to spread the coating material by centrifugal force.

Other methods may be used to apply the first coating to the core, including, but not limited to, rolling, brushing, dripping, etc.

The process for manufacturing the iron ore pellets also includes measuring a surface area coverage of the first coating on the core. In one embodiment, the surface area coverage is measured with at least one instrument selected from the group consisting of an optical microscope, an X-ray diffractometer, an X-ray fluorescence spectrometer, and a scanning electron microscope. Further, the surface area coverage may be measured upon visual inspection.

In addition to measuring the surface area coverage, other coating characteristics may be measured to determine if an acceptable amount of coating has been applied. For instance, the thickness of the coating can be measured using one or more of these techniques. Further, the measuring may involve an analysis of the porosity and/or surface roughness of the coating surface, for instance by measuring a specific surface area (i.e. BET surface area) through BET adsorption or gas permeability techniques.

In a preferred embodiment, the process further comprises drying the coated core for 0.5-24 hours, preferably 0.5-12 hours, more preferably 1-8, even more preferably 1-6 hours prior to applying the second coating. By drying the first coating prior to applying the second coating, the formation of two distinct coating layers may be obtained. The formation of two distinct layers may be advantageous to prevent pellet agglomeration and to prevent premature removal of the coatings prior to an iron reduction process.

Further, the process of applying the first coating and measuring the coating characteristics (i.e. surface area coverage, thickness, etc.) can be repeated a plurality of times in an iterative fashion until an acceptable level of coating is achieved (e.g. greater than 75% surface area coverage of the core).

The process for manufacturing the iron ore pellets also involves applying cement to the coated core to form the iron ore pellets coated with the first coating and the second coating. In one embodiment, the applying involves coating the coated core with the second coating, where the second coating covers greater than 75%, preferably greater than 85%, preferably greater than 90%, preferably greater than 95% of the surface of the coated core. Optionally, bauxite, bentonite, or dolomite, or combinations thereof can be included with the cement to form the second coating. In yet another embodiment, the cement in the second coating can be replaced with bauxite, bentonite, or dolomite, or combinations thereof.

In one embodiment, the second coating is applied to the core coated with a first coating as a slurry comprising 10-30 wt. %, preferably 15-25 wt. %, more preferably 18-22 wt. % or about 20 wt. % cement relative to the total weight of the slurry. The second coating may be applied using the techniques used to apply the first coating (e.g. spray coating, dip coating, and spin coating). Optionally, bauxite, bentonite, or dolomite, or combinations thereof can be included with the cement slurry to form the second coating. In yet another embodiment, the cement slurry can be replaced with a slurry of bauxite, bentonite, or dolomite, or combinations thereof, in the same amounts as those stated directly above with respect to the lime cement.

The process for manufacturing the iron ore pellets also includes measuring a surface area coverage of the second coating on the first coating. The second coating surface area coverage and coating characteristics can be measured using methods of analysis used to measure the first coating.

Further, the process may also include drying the second coating, and repeating the application of the second coating a plurality of times in an iterative fashion until an acceptable level of coating is achieved (e.g. greater than 75% surface area coverage of the coated core).

To test the adherence properties of the first and second coating, as well as the tendency for coatings to prevent or minimize agglomeration, the iron ore pellets may also be agitated. Agitation involves processes that create contact between surfaces of the pellets. The pellets can either be agitated against each other or a medium can be used to contact the pellets. Often a cyclical action is used to create this contact between surfaces such as the action provided by a tumble mill and/or a ball mill. The agitation can be performed either dry or wet using liquid lubricants, cleaners or abrasives. In a wet process a compound lubricant or barreling soap is added to aid the process. A wide variety of media is available to achieve the desired finished product. Common media materials include: sand, granite chips, slag, steel, ceramics and synthetics. Moreover these materials are available in a wide variety of shapes, and different shapes can be used in the same load to reach into every geometry of the pellet.

In one embodiment, the process further involves tumbling the iron ore pellets and weighing agglomerated iron ore pellets with a longest length of at least 25 mm relative to the total weight of the iron ore pellets to determine a % agglomeration. "Tumbling" as used herein, is a form of agitation designed to measure the agglomeration properties of the iron ore pellets. Tumbling may also be referred to as rumbling or barreling. As used herein, the tumbling process involves filling a vessel (e.g. a barrel, a tumbling drum, etc.) with the iron ore pellets and then rotating the vessel. As the vessel is rotated the material rises until gravity causes the uppermost layer to landslide down to the other side. The vessel may additionally have vanes which run along the inside of the vessel. As the vessel turns the vanes catch and lift the pellets, which eventually slide down or fall. This tumbling process can be configured as a batch system where batches of pellets are added, run and removed before the next batch is run or as a continuous system where the pellets enter at one end and leave at the other end in a finished state. As the iron ore pellets are tumbled, the % agglomeration will generally decrease. It is therefore advantageous to identify a first and second coating, both in amount of the coating and in terms of composition, which provides the lowest, or a low level of % agglomeration relative cores without a coating.

In one embodiment, the process further comprises rotating the iron ore pellets at 10-30 rpm, preferably 15-25 rpm, more preferably 18-22 rpm and determining the % reduction of a thickness of the first and second coating after the rotating, in terms of the average coating thickness of the sum of the first and second coating. As used herein, "rotating" refers to an agitation process designed to measure the adherence properties of the coatings by forcibly contacting the pellets to one another. The rotating may be performed using a rotating apparatus, such as a centrifuge, or a disc pelletizer, or a similar device.

It is envisaged that additional methods of agitation may be used to measure the agglomeration properties and the coating adherence properties of the first and second coatings. Other exemplary agitation techniques include, but are not limited to, sonication, vibration, shaking, stirring, and stamping.

According to a third aspect, the present disclosure relates to a process for manufacturing reduced iron pellets involving i) applying lime to a core comprising iron ore to form a coated core coated with a first coating ii) applying cement to the coated core to form the iron ore pellets coated with the first coating and the second coating and iii) reducing the iron ore pellets with a reducing gas to form reduced iron pellets. The techniques used to apply the first and second coating, as well as the measurement techniques used to analyze the coating characteristics of the applied coatings have been mentioned previously. Optionally, the first and/or the second coating can also include bauxite, bentonite, or dolomite, or combinations thereof. In yet another embodiment, the lime in the first coating or the cement in the second coating can be replaced with bauxite, bentonite, or dolomite, or combinations thereof.

In one embodiment, the process further comprises drying the coated core for 0.5-24 hours, preferably 0.5-12 hours, more preferably 1-8, even more preferably 1-6 hours prior to applying the second coating. By drying the first coating prior to applying the second coating, the formation of two distinct coating layers may be obtained. The formation of two distinct layers may be advantageous to prevent pellet agglomeration and to prevent premature removal of the coatings prior to an iron reduction process.

In one embodiment, the temperature for the reducing is up to 1100° C., preferably up to 1000° C., more preferably up to 950° C. The reducing may be performed isothermally, or alternatively, a temperature gradient may be used to reduce the iron ore throughout the reduction process. In one embodiment, the reducing gas is hydrogen ($H_2$). In one embodiment, the reducing gas is carbon monoxide (CO). In a preferred embodiment, the reducing gas comprises both hydrogen and carbon monoxide. In this scenario, other gases may be present in the reducing gas, including carbon dioxide, nitrogen, and the like. The ratio of hydrogen to carbon monoxide may be about 10:1, 9:1, 8:1, 7:1, 6:1, 5:1, 4:1, 3:1, 2:1, 1:1, 1:2, 1:3, 1:4, 1:5, 1:6, 1:7, 1:8, 1:9, or 1:10. The reducing gas of the present disclosure may be derived from natural gas, coal, or both.

In one embodiment, the iron ore pellets are reduced in a direct reduction apparatus. In one embodiment, the direct reduction apparatus is a fixed-bed reactor. Alternatively, in one embodiment, the direct reduction apparatus is a moving-bed shaft. In a preferred embodiment, the direct reduction apparatus is a vertical moving-bed shaft. In a vertical moving-bed shaft apparatus, the iron ore pellets, in one or more of their embodiments, are placed proximal to the top of the moving-bed shaft, where the iron ore pellets are heated and allowed to move towards the bottom of the moving-bed shaft gradually as they are reduced. The reducing gas is flowed countercurrent to the movement of the iron ore pellets. Then the reduced iron pellets are collected proximal to the bottom of the shaft apparatus. In a vertical moving-bed shaft reduction apparatus, the avoidance of agglomerated iron ore pellets is essential to allow the downward movement of the iron ore pellets for reduction and to allow for efficient flow of the reducing gas upwardly. Therefore, the first and second coating of the iron ore pellets may provide a more efficient direct reduction process by minimizing the formation of agglomerates. The wt. % of iron in the reduced iron pellet is greater than 90%, greater than 91%, greater than 92%, greater than 93%, greater than 94%, greater than 95%, relative to the total weight of the reduced iron pellet.

In one embodiment, the process further comprises tumbling the reduced iron pellets and weighing agglomerated reduced iron pellets with a longest length of at least 25 mm relative to the total weight of the reduced iron pellets to determine a % agglomeration.

In one embodiment, the process further includes rotating the reduced iron pellets at 10-30 rpm and determining the % reduction of a thickness of the first and second coating after the rotating, in terms of the average coating thickness of the sum of the first and second coating.

It is envisaged that the reduced iron pellets of the present disclosure may be used for the manufacture of steel and steel related products. The type of steel produced using the reduced iron pellets of the present disclosure may vary depending on added alloying elements. Steel is an alloy of iron and carbon that is widely used in construction and other applications because of its high tensile strength and low cost. Carbon, other elements, and inclusions within iron act as hardening agents that prevent the movement of dislocations that naturally exist in the iron atom crystal lattices. The carbon in typical steel alloys may contribute up to 2.1% of its weight. The steel material of the present disclosure may be any of the broadly categorized steel compositions, including carbon steels, alloy steels, stainless steels, and tool steels. Carbon steels contain trace amounts of alloying elements and account for 90% of total steel production. Carbon steels can be further categorized into three groups depending on their carbon content: low carbon steels/mild steels contain up to 0.3% carbon, medium carbon steels contain 0.3-0.6% carbon, and high carbon steels contain more than 0.6% carbon. Alloy steels contain alloying elements (e.g. manganese, silicon, nickel, titanium, copper, chromium and aluminum) in varying proportions in order to manipulate the steel's properties, such as its hardenability, corrosion resistance, strength, formability, weldability or ductility. Stainless steels generally contain between 10-20% chromium as the main alloying element and are valued for high corrosion resistance. With over 11% chromium, steel is about 200 times more resistant to corrosion than mild steel. These steels can be divided into three groups based on their crystalline structure: austenitic steels, ferritic steels, and martensitic steels. Tool steels contain tungsten, molybdenum, cobalt and vanadium in varying quantities to increase heat resistance and durability, making them ideal for cutting and drilling equipment.

In one embodiment, the reduced iron pellets manufactured by the direct reduction process are maintained at or near the temperature used during the reducing, and are transferred at this elevated temperature to a steelmaking apparatus (e.g. blast furnace, etc.), such that less heat is required to melt the reduced iron pellets during a steelmaking process.

EXAMPLES

The present invention will be described in greater detail by way of specific examples. The following examples are offered for illustrative purposes only, and are not intended to limit the invention in any manner. Those of skill in the art will readily recognize a variety of noncritical parameters which can be changed or modified to yield essentially the same results.

Example 1

Process for Making Coated Iron Ore Pellets of the Present Invention

The following Table 1 provides the materials used and processing conditions to make various coated iron ore pellets of the present invention.

TABLE 1

| | |
|---|---|
| Starting Material | Non-coated iron ore pellets |
| Reduction Temperature | 985° C. |
| Gas Mixture Ratio ($H_2$/CO) | Simulated Midrex composition |
| Lime Slurry Concentration | 10, 15, and 20%, respectively |
| Lime Coated Concentration | 1.0, 2.0, and 3.0 kg/ton iron ore, respectively |
| Cement Coating Conditions | 20% slurry conc. and 0.5 kg/ton iron ore |

It was determined that optimized primary coating conditions are 20% lime slurry concentration with 1.0 Kg lime/ton iron ore pellets at study temperature of 985° C. In one particular aspect, it was determined that a primary (lime) and secondary (cement) coating can provide adequate resistance to sticking. Application of these optimized conditions will decrease both water and coating material consumption.

The invention claimed is:

1. Iron ore pellets comprising:
- a core comprising iron ore;
- a first coating comprising lime, bauxite, or a combination thereof; and
- a second coating comprising cement, wherein the first coating is disposed between a surface of the core and the second coating, wherein the second coating comprises grains with an average particle size of 1-20 μm.

2. Iron ore pellets comprising:
- a core comprising iron ore;
- a first coating comprising lime, bauxite, or a combination thereof; and
- a second coating comprising cement,
- wherein the first coating is disposed between a surface of the core and the second coating;
- wherein an average thickness of the first coating and the second coating are each individually 50-100 μm.

3. The iron ore pellets of claim 2, wherein the first coating covers greater than 75% of the surface of the core.

4. The iron ore pellets of claim 2, wherein the first coating covers greater than 85% of the surface of the core.

5. The iron ore pellets of claim 2, which have a wt. % of the first coating ranging from 0.05-1% relative to the total weight of the iron ore pellets, and/or a wt. % of the second coating ranging from 0.05-2% relative to the total weight of the iron ore pellets.

6. The iron ore pellets of claim 2, wherein an average thickness of the first coating and the second coating are each individually 100 μm.

7. The iron ore pellets of claim 2, wherein the second coating covers greater than 75% of the surface of the first coating.

8. The iron ore pellets of claim 2, wherein the first coating contains lime.

9. The iron ore pellets of claim 2, wherein the first coating contains bauxite.

10. The iron ore pellets of claim 2, wherein the first coating contains lime and bauxite.

11. The iron ore pellets of claim 2, wherein the first and second coating reduce the formation of agglomerated iron ore pellets compared to a core without the first coating, the second coating, or both.

12. The iron ore pellets of claim 11, which have a % agglomeration of less than 5% in terms of the wt. % of agglomerated iron ore pellets with a longest length of at least 25 mm relative to the total weight of the iron ore pellets.

13. The iron ore pellets of claim 2, wherein the thickness of the first and second coating decreases by no more than 60% after rotating the iron ore pellets at 10-30 rpm, in terms of the average coating thickness of the sum of the first and second coating.

14. A process for manufacturing the iron ore pellets of claim 2, comprising:
- applying lime and/or bauxite to a core comprising iron ore to form a coated core coated with a first coating;
- measuring a surface area coverage of the first coating on the core;
- applying cement to the coated core to form the iron ore pellets coated with the first coating and the second coating; and
- measuring a surface area coverage of the second coating on the first coating,
- wherein the first coating is applied to the core as a slurry comprising 10-30 wt. % of lime and/or bauxite relative to the total weight of the slurry, and the second coating is applied to the core coated with a first coating as a slurry comprising 10-30 wt. % of cement relative to the total weight of the slurry.

15. The process of claim 14, further comprising rotating the iron ore pellets at 10-30 rpm and determining the % reduction of a thickness of the first and second coating after the rotating, in terms of the average coating thickness of the sum of the first and second coating.

16. The process of claim 14, wherein the first coating is bauxite.

17. A process for manufacturing reduced iron pellets, comprising:
- applying lime and/or bauxite to a core comprising iron ore to form a coated core coated with a first coating;
- applying cement to the coated core to form the iron ore pellets of claim 2 coated with the first coating and the second coating; and reducing the iron ore pellets with a reducing gas at temperatures up to 1100° C. to form reduced iron pellets; and tumbling the reduced iron pellets and weighing agglomerated reduced iron pellets with a longest length of at least 25 mm relative to the total weight of the reduced iron pellets to determine a % agglomeration.

18. The process of claim 17, further comprising rotating the reduced iron pellets at 10-30 rpm and determining the % reduction of a thickness of the first and second coating after the rotating, in terms of the average coating thickness of the sum of the first and second coating.

* * * * *